US007948223B2

(12) United States Patent
Nagata et al.

(10) Patent No.: US 7,948,223 B2
(45) **Date of Patent: *May 24, 2011**

(54) CONSTANT VOLTAGE CIRCUIT USING PLURAL ERROR AMPLIFIERS TO IMPROVE RESPONSE SPEED

(75) Inventors: Toshihisa Nagata, Hyogo (JP); Kohji Yoshii, Hyogo (JP); Yusuke Minakuchi, Nara (JP)

(73) Assignee: Ricoh Company, Ltd., Tokyo (JP)

( * ) Notice: Subject to any disclaimer, the term of this patent is extended or adjusted under 35 U.S.C. 154(b) by 371 days.

This patent is subject to a terminal disclaimer.

(21) Appl. No.: 12/057,294

(22) Filed: Mar. 27, 2008

(65) Prior Publication Data

US 2008/0238385 A1 Oct. 2, 2008

Related U.S. Application Data

(63) Continuation of application No. 11/090,205, filed on Mar. 28, 2005, now Pat. No. 7,368,896.

(30) Foreign Application Priority Data

| | | |
|---|---|---|
| Mar. 29, 2004 | (JP) | 2004-095544 |
| May 10, 2004 | (JP) | 2004-139948 |
| Mar. 11, 2005 | (JP) | 2005-069480 |
| Mar. 11, 2005 | (JP) | 2005-069491 |

(51) Int. Cl.
*G05F 1/56* (2006.01)

(52) U.S. Cl. ..... 323/280; 323/281

(58) Field of Classification Search ..... 323/280, 323/273, 286, 281, 275, 279, 274, 276–278, 323/282; 327/541
See application file for complete search history.

(56) References Cited

U.S. PATENT DOCUMENTS

| | | | |
|---|---|---|---|
| 5,442,277 | A | 8/1995 | Mori et al. |
| 5,512,814 | A | 4/1996 | Allman |
| 5,982,226 | A | 11/1999 | Rincon-Mora |
| 6,236,194 | B1 | 5/2001 | Manabe et al. |
| 6,465,994 | B1 | 10/2002 | Xi |
| 6,617,833 | B1 | 9/2003 | Xi |
| 6,657,838 | B2 | 12/2003 | Min |
| 6,703,815 | B2 | 3/2004 | Biagi |
| 6,856,124 | B2 | 2/2005 | Dearn et al. |
| 7,002,329 | B2 | 2/2006 | Agari et al. |
| 7,142,042 | B1 | 11/2006 | Henry |
| 2006/0232327 | A1 | 10/2006 | Takagi et al. |

FOREIGN PATENT DOCUMENTS

| | | |
|---|---|---|
| JP | 03-158912 A | 7/1991 |
| JP | 06-295211 | 10/1994 |
| JP | 3068044 | 5/2000 |
| JP | 2001-101862 | 4/2001 |
| JP | 2002-312043 | 10/2002 |

*Primary Examiner* — Harry Behm
(74) *Attorney, Agent, or Firm* — Dickstein Shapiro LLP

(57) ABSTRACT

A constant voltage circuit that is capable of realizing high speed response with respect to an abrupt change in an input voltage or a load current is disclosed. The constant voltage circuit includes a first error amplifier with a high direct current gain and a second error amplifier with high speed responsiveness with respect to a change in an output voltage. The constant voltage circuit uses the first and second error amplifiers to conduct operation control of an output voltage control transistor in response to a change in the output voltage.

5 Claims, 5 Drawing Sheets

CONSTANT VOLTAGE CIRCUIT USING PLURAL ERROR AMPLIFIERS TO IMPROVE RESPONSE SPEED

CROSS-REFERENCE TO RELATED APPLICATION

This application is a continuation of U.S. patent application Ser. No. 11/090,205, filed on Mar. 28, 2005, now U.S. Pat. No. 7,368,896 which claims the benefit of the filing date of Japanese Application No. 2004-095544, filed Mar. 29, 2004, Japanese Application No. 2004-139948, filed May 10, 2004, Japanese Application No. 2005-069480, filed Mar. 11, 2005 and Japanese Application No. 2005-069491, filed Mar. 11, 2005, the complete disclosures of which are incorporated by reference in their entireties herein.

BACKGROUND OF THE INVENTION

1. Field of the Invention

The present invention relates generally to a constant voltage circuit that uses an error amplifier, and particularly to a technique for increasing the response speed for responding to an abrupt change in an input voltage or a load current.

The present invention also relates to a constant voltage circuit that uses an error amplifier including a frequency compensation circuit that conducts phase compensation.

2. Description of the Related Art

Conventionally, an error amplifier used in a constant voltage circuit includes a frequency compensation circuit that conducts phase compensation in order to prevent unstable operation such as oscillation.

FIG. 1 is a circuit diagram showing an exemplary configuration of a constant voltage circuit according to the prior art.

In the constant voltage circuit 100 of FIG. 1, an error amplifier AMPa includes NMOS transistors M103 and M104 that realize a differential pair, PMOS transistors M105 and M106 forming a current mirror circuit that realizes a load of the differential pair, and a NMOS transistor M102 that corresponds to a constant current source that supplies a bias current to the differential pair. Further, the error amplifier AMPa includes a PMOS transistor M107 and an NMOS transistor M108 that realize an output circuit, and a resistor R103 and a condenser C101 that realize a frequency compensation circuit.

In the error amplifier AMPa as is described above, a divided voltage VFBa of an output voltage Vout that is generated by resistors R101 and R102 is input to a gate of the NMOS transistor M104 corresponding to a non-inverting input terminal, and a predetermined reference voltage Vs from a reference voltage generating circuit 101 is input to a gate of the NMOS transistor 103 corresponding to an inverting input terminal. The error amplifier AMPa conducts operation control of an output voltage control transistor M101 so that the divided voltage VFBa corresponds to the reference voltage Vs, and controls the current that is output from the output voltage control transistor M101 to a load.

It is noted that various applications of a constant voltage circuit have been developed in the prior art. For example, Japanese Laid-Open Patent Publication No. 2001-101862 discloses a semiconductor device that is capable of stabilizing an output voltage of a power source circuit and reducing current consumption at the same time. Japanese Laid-Open Patent Publication No. 2002-312043 discloses a voltage regulator that is capable of increasing a response speed according to a load state, and reducing the current consumption rate without increasing the chip area.

Also, Japanese Laid-Open Patent Publication No. 11-150428 discloses a differential amplifier that is capable of easing the gain decrease at a high frequency band of an input signal.

Generally, an error amplifier of a constant voltage circuit is designed to have good direct current characteristics. In this regard, the error amplifier is arranged to realize a high direct current gain, and in turn, the bias current supplied to the differential pair is arranged to be low. However, in such an arrangement, a relatively long period of time is needed to charge the condenser C101 of the frequency compensation circuit and the input capacitance of the output voltage control transistor M101, and consequently, the response speed for responding to an abrupt change in an input voltage Vin or a load current may be relatively slow.

SUMMARY OF THE INVENTION

The present invention has been conceived in response to one or more of the problems of the related art, and it object is to provide a constant voltage circuit that is capable of increasing the response speed for responding to an abrupt change in an input voltage or a load current.

According to an aspect of the present invention, a constant voltage circuit is provided that converts an input voltage input to an input terminal into a predetermined constant voltage, and outputs the predetermined constant voltage from an output terminal, the constant voltage circuit including:

an output voltage control transistor that inputs a control signal from the input terminal and outputs a current according to the input control signal to the output terminal;

a reference voltage generating circuit unit that generates and outputs a predetermined reference voltage;

an output voltage detection circuit unit that detects an output voltage from the output terminal, and generates and outputs a proportional voltage that is proportional to the detected output voltage; and an error amplifying circuit unit that conducts operation control of the output voltage control transistor to adjust the proportional voltage to correspond to the reference voltage; wherein the error amplifying circuit unit includes a first error amplifier and a second error amplifier that have differing characteristics and are configured to conduct the operation control of the output voltage control transistor at the same time.

According to a preferred embodiment of the present invention, the direct current gain of the first error amplifier is arranged to be greater than the direct current gain of the second error amplifier.

According to another preferred embodiment of the present invention, the response speed of the second error amplifier for responding to a change in the output voltage is arranged to be faster than the response speed of the first error amplifier for responding to the change in the output voltage.

According to another aspect of the present invention, a constant voltage circuit that converts an input voltage input to an input terminal into a predetermined constant voltage and outputs the predetermined constant voltage from an output terminal, the constant voltage circuit including:

an output voltage control transistor that inputs a control signal from the input terminal and outputs a current according to the input control signal to the output terminal;

a reference voltage generating circuit unit that generates and outputs a predetermined reference voltage;

an output voltage detection circuit unit that detects an output voltage from the output terminal, and generates and outputs a proportional voltage that is proportional to the detected output voltage; and an error amplifying circuit unit that conducts operation control of the output voltage control transistor to adjust the proportional voltage to correspond to the reference voltage; wherein the error amplifying circuit unit includes a first error amplifier that conducts the operation control of the output voltage to adjust the proportional voltage VBF to correspond to the reference voltage Vr; and a second error amplifier with a higher response speed for responding to a change in the output voltage compared to the response speed of the first error amplifier, the second error amplifier being configured to increase the output current of the output voltage control transistor for a predetermined amount of time in response to a sudden decrease in the output voltage.

According to a preferred embodiment of the present invention, the direct current gain of the first error amplifier is greater than the direct current gain of the second error amplifier.

According to another preferred embodiment of the present invention, the second error amplifier only amplifies an alternating current component of the output voltage Vout.

According to another preferred embodiment of the present invention, the second error amplifier includes a control transistor that conducts operation control of the output voltage control transistor according to an input control signal;

a differential amplifying circuit that includes a first input terminal and a second input terminal, and is configured to input a predetermined bias voltage via the first input terminal and conduct operation control of the control transistor to adjust a voltage of the second input terminal to correspond to the predetermined bias voltage;

a condenser that is connected between the second input terminal of the differential amplifying circuit and the output voltage; and a fixed resistor that is connected between the first input terminal and the second input terminal of the differential amplifying circuit.

According to another preferred embodiment of the present invention, the differential amplifying circuit includes a first transistor and a second transistor that realize a differential pair, an offset being set to at least one of the first and second transistors; and when a voltage change of the output voltage is less than or equal to a predetermined value, a current flowing in one of the first and second transistors of the differential pair is arranged to be lower than a current flowing in the other one of the first and second transistors.

According to a preferred embodiment of the present invention, normally, the first error amplifier with good direct current characteristics conducts operation control of the output voltage control transistor to obtain a constant output voltage; however, when the output voltage suddenly decreases, the second error amplifier with high speed responding characteristics conducts operation control of the output voltage control transistor for a predetermined amount of time before the first error amplifier responds to the decrease and conducts the operation control of the output voltage control transistor.

DESCRIPTION OF THE PREFERRED EMBODIMENTS

In the following, preferred embodiments of the present invention are described with reference to the accompanying drawings.

First Embodiment

Figure 1:
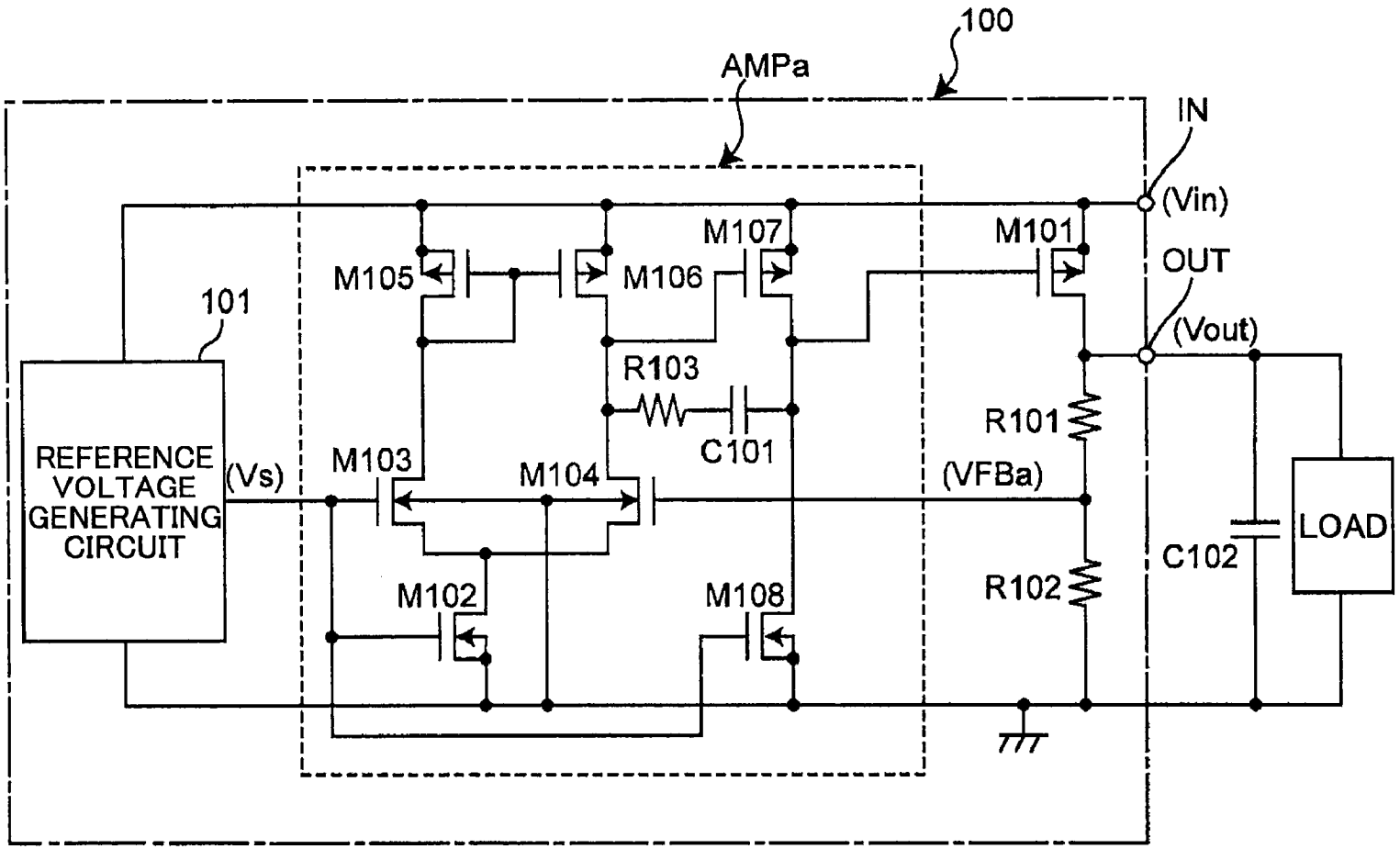
FIG.1 PRIOR ART
FIG. 1 is a circuit diagram showing an exemplary configuration of a constant voltage circuit according to the prior art.
Figure 2:
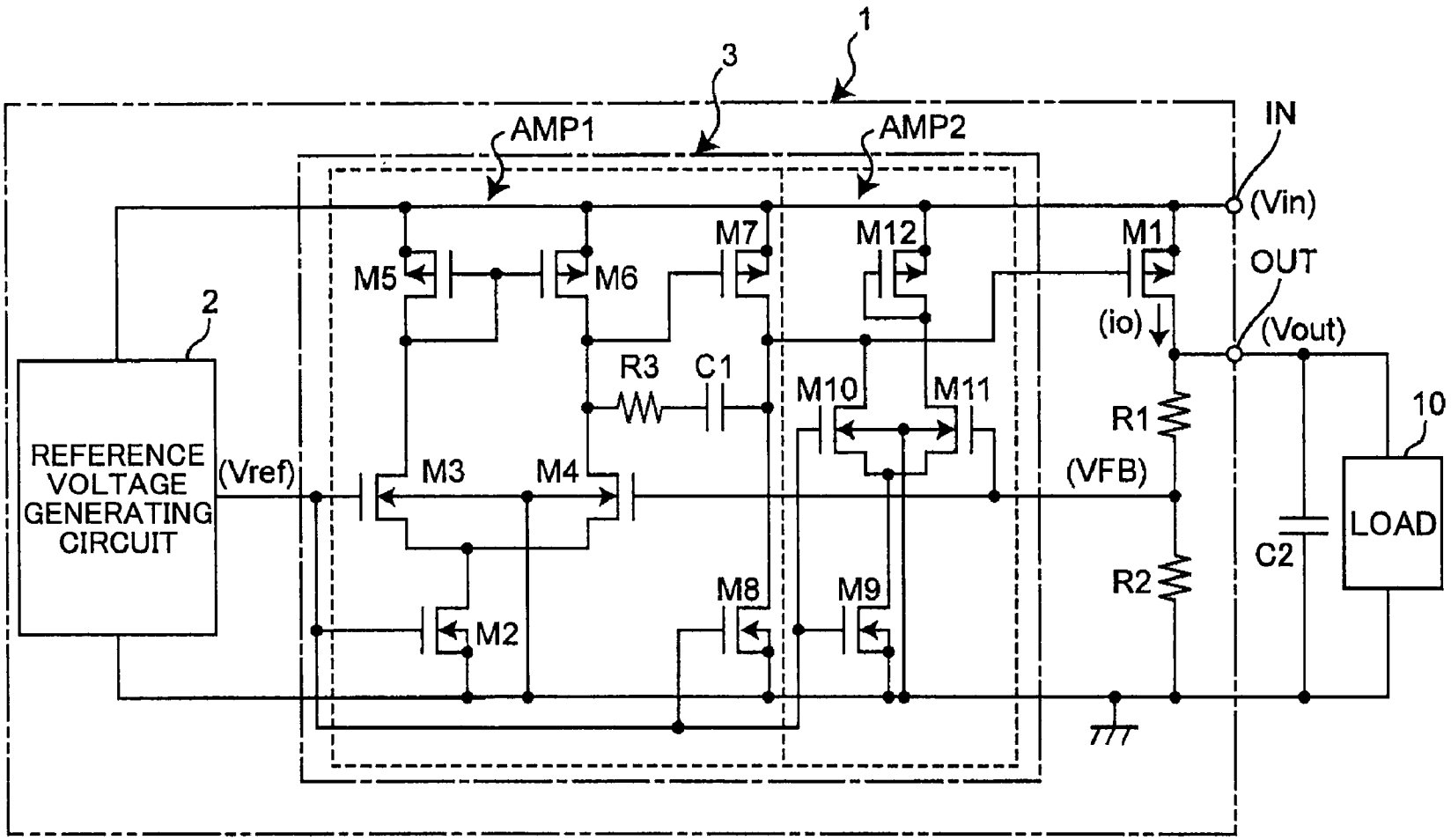
FIG. 2 is a circuit diagram showing an exemplary configuration of a constant voltage circuit according to a first embodiment of the present invention.

FIG. 2 is a circuit diagram showing an exemplary configuration of a constant voltage circuit according to a first embodiment of the present invention.

The constant voltage circuit 1 of FIG. 2 generates a predetermined constant voltage from an input voltage Vin and outputs the generated constant voltage via an output terminal OUT. It is noted that a load 10 and a condenser C2 are connected in parallel between the output terminal OUT and the ground voltage.

The constant voltage circuit 1 includes a reference voltage generating circuit 2 that generates and outputs a predetermined reference voltage Vref, output voltage detection resistors R1 and R2 that divide an output voltage Vout to generate and output a divided voltage VFB, an output voltage control transistor M1 corresponding to a PMOS transistor that controls a current io that is output to the output terminal OUT according to a signal input to its gate, and an error amplifying circuit unit 3 that controls the operation of the output voltage control transistor M1 so that the divided voltage VFB corresponds to the reference voltage Vref. It is noted that the reference voltage generating circuit 2 corresponds to an embodiment of a reference voltage generating circuit unit of the present invention, and the resistors R1 and R2 correspond to an embodiment of an output voltage detection circuit unit of the present invention.

The error amplifying circuit unit 3 includes first and second amplifiers AMP1 and AMP2. It is noted that the reference voltage Vref is input to non-inverting input terminals of the first and second error amplifiers AMP1 and AMP2, and the divided voltage VFB is input to inverting input terminals of the first and second error amplifiers AMP1 and AMP2. It is noted that the operation of the output voltage control transistor M1 is controlled by the respective output signals of the first and second error amplifiers AMP1 and AMP2.

The output voltage control transistor M1 is connected between the input terminal IN and the output terminal OUT, and output terminals of the first and second error amplifiers AMP1 and AMP2 are connected to a gate of the output voltage control transistor M1. Also, a serial circuit realized by the resistors R1 and R2 is connected between the output terminal OUT and the ground voltage, and the divided voltage VFB is output from the connection point of the resistors R1 and R2.

The first error amplifier AMP1 includes NMOS transistors M2~M4 and M8, PMOS transistors M5~M7, a condenser C1 and a resistor R3. The second error amplifier AMP2 includes NMOS transistors M9-M11 and a PMOS transistor M12.

The NMOS transistor M3 and M4 realize a differential pair, and the PMOS transistors M5 and M6 realize a current mirror circuit that corresponds to a load of the differential pair. It is noted that the sources of the PMOS transistors M5 and M6 are connected to the input terminal IN, the gates of the PMOS transistors M5 and M6 are interconnected, and the connection point of the gates of the PMOS transistors M5 and M6 is connected to the drain of the PMOS transistor M5.

The drain of the PMOS transistor M5 is connected to the drain of the NMOS transistor M3, and the drain of the PMOS transistor M6 is connected to the drain of the NMOS transistor M4. The sources of the NMOS transistors M3 and M4 are interconnected, and the NMOS transistor M2 is connected between the connection point of the sources of the NMOS transistors M3 and M4 and the ground voltage. The reference voltage generating circuit 2 is activated by the input voltage Vin as the power source voltage. The reference voltage Vref is input to the gates of the NMOS transistors M2 and M3. The NMOS transistor M2 corresponds to a constant current source. The divided voltage VFB is input to the gate of the NMOS transistor M4.

The PMOS transistor M7 and the NMOS transistor M8 are serially connected between the input terminal IN and the ground voltage, and the connection point of the PMOS transistor M7 and the NMOS transistor M8 realizes an output terminal of the first error amplifier AMP1 that is connected to the gate of the output voltage control transistor M1. The gate of the PMOS transistor M7 is connected to the connection point of the PMOS transistor M6 and the NMOS transistor M4. The reference voltage Vref is input to the gate of the NMOS transistor M8, and the NMOS transistor M8 realizes a constant current source. The condenser C1 and the resistor R3 that realize a frequency compensation circuit are serially connected between the connection point of the PMOS transistor M6 and the NMOS transistor M4 and the connection point of the PMOS transistor M7 and the NMOS transistor M8.

In the second error amplifier AMP2, the NMOS transistors M10 and M11 realize a differential pair, and the PMOS transistor M12 is connected between the input terminal IN and the drain of the NMOS transistor M11. The gate of the PMOS transistor M12 is connected to its drain. The drain of the NMOS transistor M10 is connected to the gate of the output voltage control transistor M1, the sources of the NMOS transistors M10 and M11 are interconnected, and the NMOS transistor M9 is connected between the connection point of the sources of the NMOS transistors M10 and M11 and the ground voltage. The reference voltage Vref is input to the gates of the NMOS transistors M9 and M10, and the divided voltage VFB is input to the gate of the NMOS transistor M11. The NMOS transistor M9 corresponds to a constant current source, and the drain of the NMOS transistor M10 corresponds to an output terminal of the second error amplifier AMP2.

According to the present embodiment, the first error amplifier AMP1 is designed to realize a high direct current gain in order to achieve good direct current characteristics, and in this regard, the drain current of the NMOS transistor M2 corresponding to the constant current source is arranged to be low. The second error amplifier AMP2 is designed so that a high drain current may be obtained at the NMOS transistor M9 in order to realize high speed operation. In such an arrangement, when an abrupt change occurs in the input voltage or the load current, the second error amplifier may quickly respond to such a change and control the operation of the output voltage control transistor M1 accordingly, and the first error amplifier AMP1 may follow the second error amplifier AMP2 in responding to the change and control the operation of the output voltage control transistor M1. In this way, the output voltage control transistor M1 may be controlled by the first and second error amplifiers AMP1 and AMP2.

As is described above, the constant voltage circuit 1 according to the first embodiment uses the first error amplifier AMP1 that is designed to realize a high direct current gain, and the second error amplifier AMP2 that is designed to have high speed responding characteristics to control the operation of the output voltage control transistor M1 with respect to a change in the output voltage Vout. In this way, the response speed for responding to an abrupt change in the input voltage or the load current may be increased, and a constant voltage circuit with good direct current characteristics as well as high speed responding characteristics may be realized.

Figure 3:
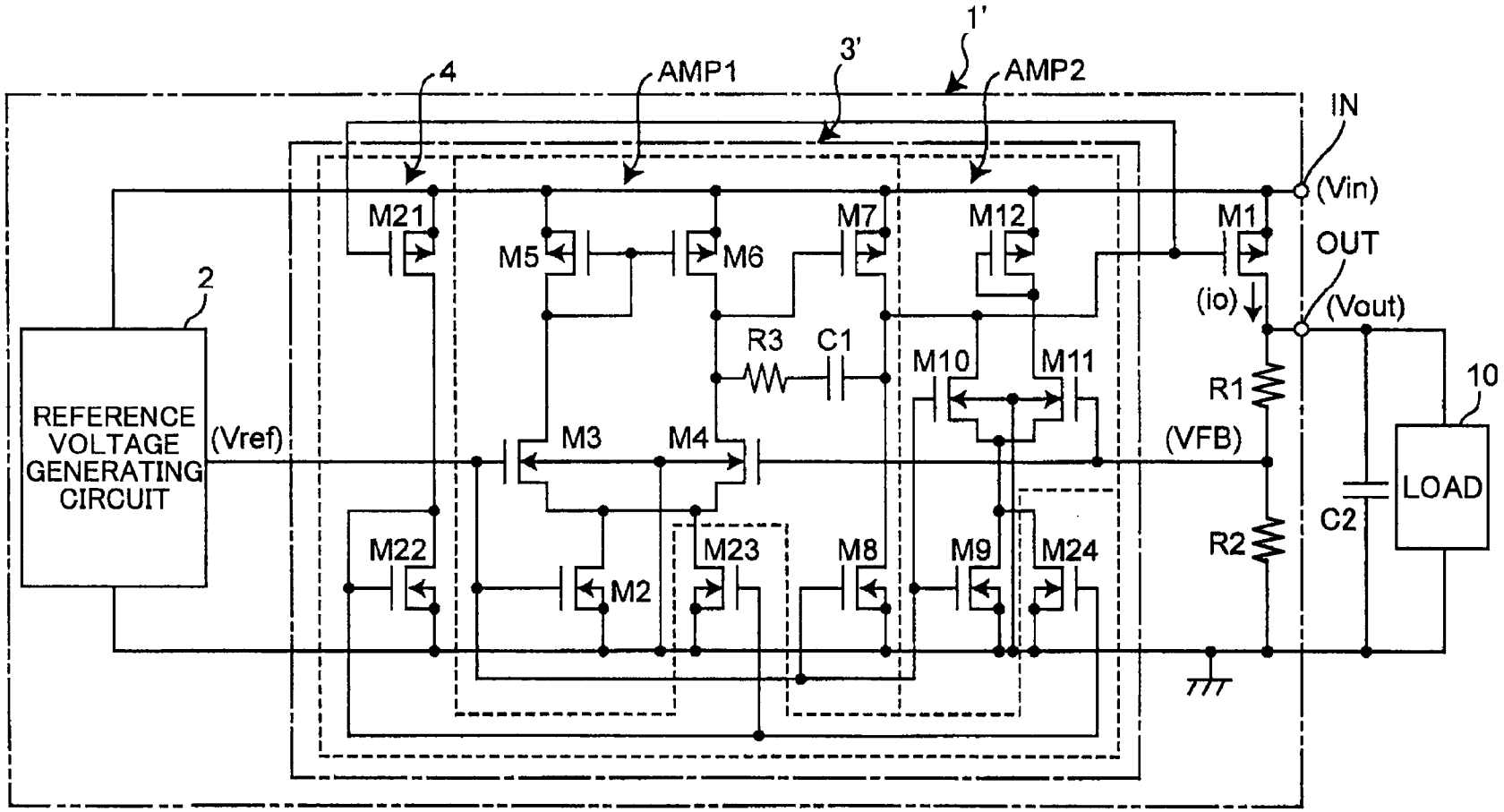
FIG. 3 is a circuit diagram showing another exemplary configuration of a constant voltage circuit according to a modified embodiment of the first embodiment.

FIG. 3 is a circuit diagram showing an exemplary configuration of a constant voltage circuit according to a modified embodiment of the first embodiment. According to the embodiment of FIG. 3, the bias currents of the first and second error amplifiers AMP1 and AMP2 are arranged to vary depending on the output current io. It is noted that in FIG. 3, components that are identical to those shown in FIG. 2 are assigned the same numerical references and their descriptions are omitted.

The constant voltage circuit 1' of FIG. 3 differs from the constant voltage circuit 1 of FIG. 2 in that it includes a bias current adjusting circuit 4 for adjusting the bias currents of the first and second error amplifiers AMP1 and AMP2 according to the output current io.

The error amplifying circuit unit 3' of FIG. 3 includes the first and second error amplifiers AMP1 and AMP2 and the bias current adjusting circuit 4. The bias current adjusting circuit 4 includes a PMOS transistor M21 and NMOS transistors M22~M24. The PMOS transistor M21 and the NMOS transistor M22 are serially connected between the input terminal IN and the ground voltage, and the gate of the PMOS transistor M21 is connected to the gate of the output voltage control transistor M1. The NMOS transistors M22~M24 form a current mirror circuit, and their respective gates are interconnected. The connection point of the gates of the NMOS transistors M22~M24 is connected to the drain of the NMOS transistor M22. The NMOS transistor M23 is connected in parallel with the NMOS transistor M2 of the first error amplifier AMP1, and the NMOS transistor M24 is connected in parallel with the NMOS transistor M9 of the second error amplifier AMP2.

According to the present embodiment, the transistor size of the PMOS transistor M21 is designed to be $1/1000$~$1/10000$ the size of the output voltage control transistor M1, and the PMOS transistor M21 is arranged to output a current in proportion to the output current io. The current output by the PMOS transistor M21 that is proportional to the output current io is generated by the current mirror circuit that is realized by the NMOS transistors M22~M24. The generated proportional current is supplied as a bias current to the NMOS transistors M3 and M4 realizing a differential pair via the NMOS transistor M23, and the generated proportional current is supplied as a bias current to the NMOS transistors M10 and M11 realizing a differential pair via the NMOS transistor M24. It is noted that the transistor size of the NMOS transistor M24 is arranged to be larger than that of the NMOS transistor M23.

According to the present embodiment, the NMOS transistors M3 and M4 realizing a differential pair in the first error amplifier AMP1 receive a predetermined bias current from the NMOS transistor M2 and a bias current that is proportional to the output current io from the PMOS transistor M21 and the NMOS transistors M22 and M23. The NMOS transistors M10 and M11 realizing a differential pair in the second error amplifier AMP2 receive a predetermined bias current from the NMOS transistor M9 and a bias current that is proportional to the output current io from the PMOS transistor M21 and the NMOS transistors M22 and M24. In this way, the constant voltage circuit 1' according to the present embodiment may realize an increased response speed for responding to a change in the output voltage Vout according to a change in the output current io in addition to realizing the advantageous effects of the constant voltage circuit 1 of the first embodiment.

Second Embodiment

Figure 4:
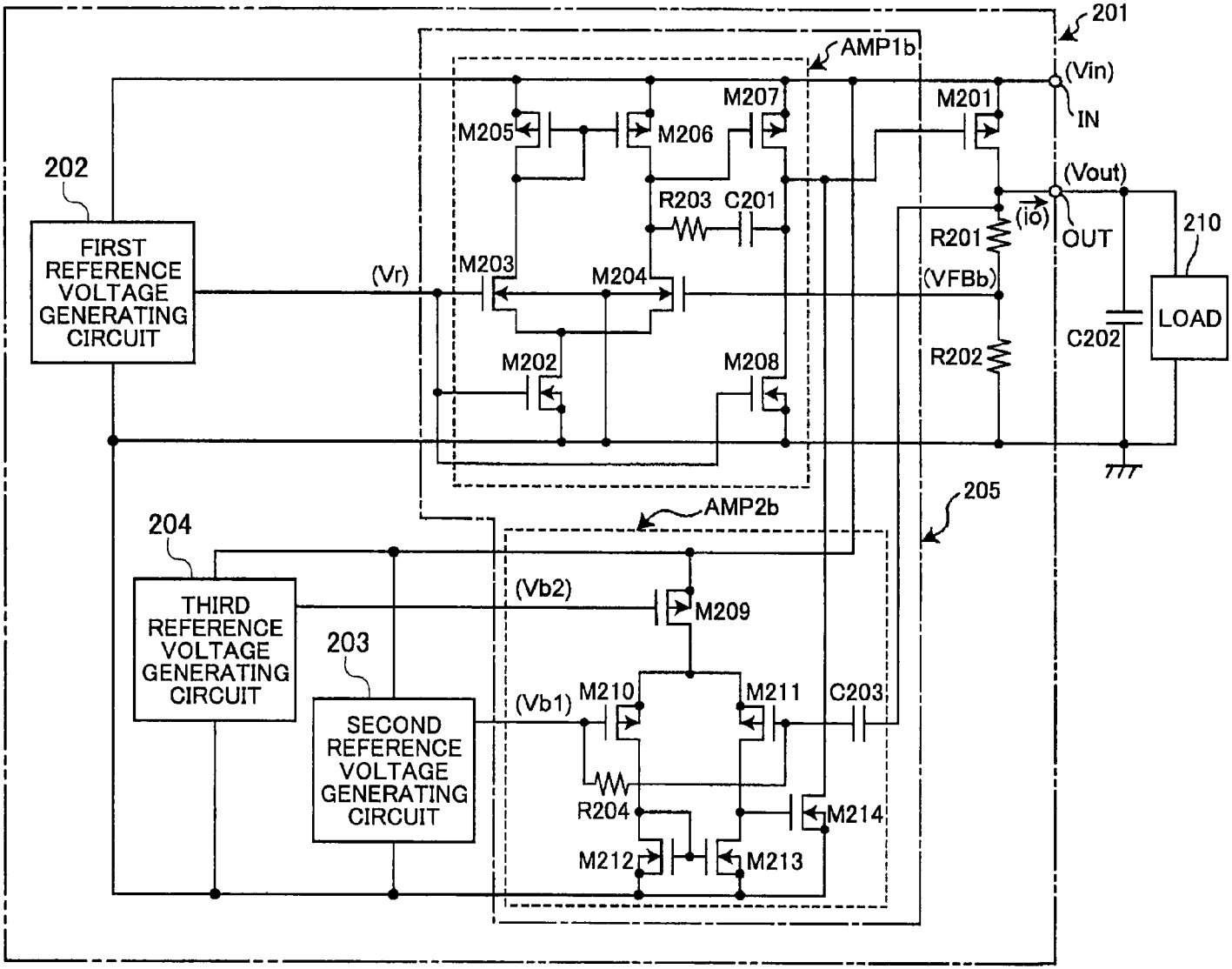
FIG. 4 is a circuit diagram showing an exemplary configuration of a constant voltage circuit according to a second embodiment of the present invention.

FIG. 4 is a circuit diagram showing a configuration of a constant voltage circuit according to a second embodiment of the present invention.

The constant voltage circuit 201 of FIG. 4 generates a predetermined constant voltage from an input voltage Vin and outputs the generated voltage as an output voltage Vout via an output terminal OUT. It is noted that a load 210 and a condenser 202 are connected in parallel between the output terminal OUT and the ground voltage.

The constant voltage circuit 201 includes a first reference voltage generating circuit 202 that generates and outputs a predetermined reference voltage Vr, a second reference voltage generating circuit 203 that generates and outputs a predetermined reference voltage Vb1, a third reference voltage generating circuit 204 that generates and outputs a predetermined bias voltage Vb2, output voltage detection resistors R201 and R202 that generate and output a divided voltage VFBb of the output voltage Vout, an output voltage control transistor M201 corresponding to a PMOS transistor that controls a current io that is output to the output terminal OUT according to a signal input to its gate, and an error amplifying circuit unit 205 that controls the operation of the output voltage control transistor M201 so that the divided voltage VFBb corresponds to the reference voltage Vr. It is noted that the first reference voltage generating circuit 202 corresponds to an embodiment of a reference voltage generating circuit unit of the present invention, and the resistors R201 and R202 correspond to an embodiment of an output voltage detection circuit unit of the present invention.

The error amplifying circuit unit 205 includes first and second error amplifiers AMP1*b* and AMP2*b*. The reference voltage Vr is input to a non-inverting input terminal of the first error amplifier AMP1*b*, and the divided voltage VFBb is input to an inverting input terminal of the first error amplifier AMP1*b*. Also, the reference voltage Vb1 is input to a non-inverting input terminal of the second error amplifier AMP2*b*, and the output voltage Vout is input to an inverting input terminal of the second error amplifier AMP2*b*. It is noted that the operation of the output voltage control transistor M201 is controlled by the respective output signals of the first and second error amplifiers AMP1*b* and AMP2*b*.

The output voltage control transistor M1 is connected between the input terminal IN and the output terminal OUT, and output terminals of the first and second error amplifiers AMP1*b* and AMP2*b* are connected to the gate of the output voltage control transistor M1. A serial circuit that is realized by the resistors R201 and R202 is connected between the output terminal OUT and the ground voltage, and the divided voltage VFBb is output from the connection point of the resistors R201 and R202.

The first error amplifier AMP1*b* includes NMOS transistors M202~M204 and M208, PMOS transistors M205~M207, a condenser C201, and a resistor R203. The second error amplifier AMP2*b* includes PMOS transistors M209~M211, NMOS transistors M212~M214, a condenser C203, and a resistor R204.

The NMOS transistors M203 and M204 realize a differential pair, and the PMOS transistors M205 and M206 realize a current mirror circuit corresponding to a load of the differential pair. The sources of the PMOS transistors M205 and M206 are connected to the input terminal IN, and the gates of the PMOS transistors M205 and M206 are interconnected. The connection point of the gates of the PMOS transistors M205 and M206 is connected to the drain of the PMOS transistor M205. The drain of the PMOS transistor M205 is connected to the drain of the NMOS transistor M203, and the drain of the PMOS transistor M206 is connected to the drain of the NMOS transistor M204. The sources of the NMOS transistors M203 and M204 are interconnected, and the NMOS transistor M2 is connected between the connection point of the sources of the NMOS transistors M203 and M204 and the ground voltage. The first reference voltage generating circuit 202 is activated by the input voltage Vin as the power source voltage, and the NMOS transistor M202 realizes a constant current source. The divided voltage VFBb is input to the gate of the NMOS transistor M204.

Also, the PMOS transistor M207 and the NMOS transistor M208 are serially connected between the input terminal IN and the ground voltage, and the connection point of the PMOS transistor M207 and the NMOS transistor M208 that corresponds to an output terminal of the first error amplifier AMP1*b* is connected to the gate of the output voltage control transistor M201. The gate of the PMOS transistor M207 is connected to the connection point of the PMOS transistor M206 and the NMOS transistor M204, and the reference voltage Vr is input to the gate of the NMOS transistor M208, which realizes a constant current source. The condenser C201 and the resistor R203 that realize a frequency compensation circuit are serially connected between the connection point of the PMOS transistor M206 and the NMOS transistor M204 and the connection point of the PMOS transistor M207 and the NMOS transistor M208.

In the second error amplifier AMP2*b*, the PMOS transistors M210 and M211 realize a differential pair, and the NMOS transistors M212 and M213 form a current mirror circuit that realizes a load of the differential pair. The sources of the NMOS transistors M212 and M213 are connected to the ground voltage, and the gates of the NMOS transistors M212 and M213 are interconnected. The connection point of the gates of the NMOS transistors M212 and M213 is connected to the drain of the NMOS transistor M212. The drain of the NMOS transistor M212 is connected to the drain of the PMOS transistor M210, and the drain of the NMOS transistor M213 is connected to the drain of the PMOS transistor M211. The sources of the PMOS transistors M210 and M211 are interconnected, and the PMOS transistor M209 is connected between the connection point of the sources of the PMOS transistors M210 and M211 and the input terminal IN.

The second reference voltage generating circuit 203 and the third reference voltage generating circuit 204 are activated by the input voltage Vin as the power source. The bias voltage Vb2 generated by the third reference voltage generating circuit 204 is input to the gate of the PMOS transistor M209, and the reference voltage Vb1 generated by the second reference voltage generating circuit 203 is input to the gate of the PMOS transistor M210. The PMOS transistor M209 realizes a constant current source. The condenser C203 is connected between the gate of the PMOS transistor M211 and the output terminal OUT, and the reference voltage Vb1 is input to the connection point of gate of the PMOS transistor M211 and the condenser C203 via the resistor R204. The NMOS transistor M214 is connected between the gate of the output voltage control transistor M201 and the ground voltage, and the gate of the NMOS transistor M214 is connected to the connection point of the PMOS transistor M211 and the NMOS transistor M213. The drain of the NMOS transistor M214 realizes an output terminal of the second error amplifier AMP2*b*.

According to the present embodiment, the first error amplifier AMP1*b* is designed to realize a high direct current gain so that good direct current characteristics may be obtained, and in turn, the drain current of the NMOS transistor M202 corresponding to the constant current source is arranged to be low. In the second error amplifier AMP2*b*, the gate of the PMOS transistor 211 corresponding to the input terminal is connected to the output terminal OUT via the condenser C203 corresponding to a coupling condenser, and thereby, the second error amplifier AMP2*b* is capable of amplifying only the alternating current components of the output voltage Vout.

It is also noted that the second error amplifier AMP2*b* is designed to secure a high drain current for the PMOS transistor M209 corresponding to the constant current source so that high speed operation may be realized. According to the present embodiment, when there is an abrupt change in the output voltage Vout, particularly, when the output current io suddenly increases and the output voltage Vout suddenly decreases, the second error amplifier AMP2*b* may control the operation of the output voltage control transistor M201 for a predetermined amount of time. The second error amplifier AMP2*b* may quickly respond to the sudden decrease of the output voltage Vout and control the operation of the output voltage control transistor M201 to increase the output voltage Vout.

In the following, a detailed description is given concerning the operation of the constant voltage circuit 201 in a case where the current flowing in the load 210 suddenly increases and the output voltage Vout suddenly decreases.

As is described above, since the response speed of the first error amplifier AMP1*b* in responding to an abrupt change in the output voltage Vout is slow, when the output voltage Vout suddenly decreases, it may take a certain amount of time before the first error amplifier AMP1*b* can respond to the decrease in the output voltage Vout and control the operation of the output voltage control transistor M201 to increase the output current io. On the other hand, the second error amplifier AMP2*b* is capable of quickly responding to an abrupt change in the output voltage Vout, and thereby, when the output voltage Vout suddenly decreases, the second error amplifier AMP2*b* may respond to the change and control the operation of the output voltage control transistor M201 to increase the output current io.

In the second error amplifier AMP2*b*, when the output voltage Vout suddenly decreases, the gate voltage of the PMOS transistor M211 decreases via the condenser C203, the drain current of the PMOS transistor M211 increases, and the gate voltage of the NMOS transistor M214 increases. In turn, the drain current of the NMOS transistor M214 increases, and the gate voltage of the output voltage control transistor M202 decreases so that the drain current of the output voltage control transistor M201 increases. In this way, the output current io is increased to prevent the decrease of the output voltage Vout.

It is noted that the gate voltage of the PMOS transistor M211 is adjusted to correspond to the reference voltage Vb1 after a predetermined amount of time elapses from the time the output voltage Vout decreases, the predetermined time being determined by a time constant of the resistor R204 and the condenser C203. It is noted that the responsiveness of the second error amplifier AMP2*b* with respect to a change in the output voltage Vout may be improved by increasing the time constant of the resistor R204 and the condenser C203, and the responsiveness of the error amplifier AMP2*b* may be degraded by decreasing the time constant. Taking into account other factors such as the layout area, the resistance of the resistor R204 may be set to a value around 2 MΩ, and the capacitance of the condenser C203 may be set to a value around 5 pF, for example.

It is noted that an offset is set to at least one of the PMOS transistors M210 and M211, and when the same voltage is input to the gates of the PMOS transistors M210 and M211, the PMOS transistor M210 is arranged to output a high current whereas the PMOS transistor M211 is arranged to output a low current. For example, the transistor size of the PMOS transistor M210 may be set to W (gate width)/L (gate length) =40 μm/2 μm, and the transistor size of the PMOS transistor M211 may be set to W/L=32 μm/2 μm. According to the present embodiment, the ratio of the transistor sizes of the PMOS transistor M210 and the PMOS transistor M211 may be arranged to be approximately 10:8.

Accordingly, when there is no sudden decrease in the output voltage Vout, operation control of the output voltage control transistor M201 is not conducted by the NMOS transistor M14. In other words, during normal operation, the second error amplifier AMP2*b* does not influence the operation control of the output voltage control transistor M201 conducted by the first error amplifier AMP1*b*.

As is described above, in the constant voltage circuit according to the present embodiment, during normal operation, the first error amplifier AMP1*b* having good direct current characteristics is used to realize operation control of the output voltage control transistor M201 to obtain a constant output voltage Vout, and when the output voltage suddenly decreases, the second error amplifier AMP2*b* having high speed responding characteristics is used for a predetermined amount of time to realize operation control of the output voltage control transistor M201 to obtain a constant output voltage Vout before the first error amplifier AMP1*b* responds to the decrease and starts operation control of the output voltage control transistor M201. In this way, the response speed for responding to an abrupt change in the input voltage or the load current may be increased, and a constant voltage circuit with good direct current characteristics as well as high speed responding characteristics may be realized.

Figure 5:
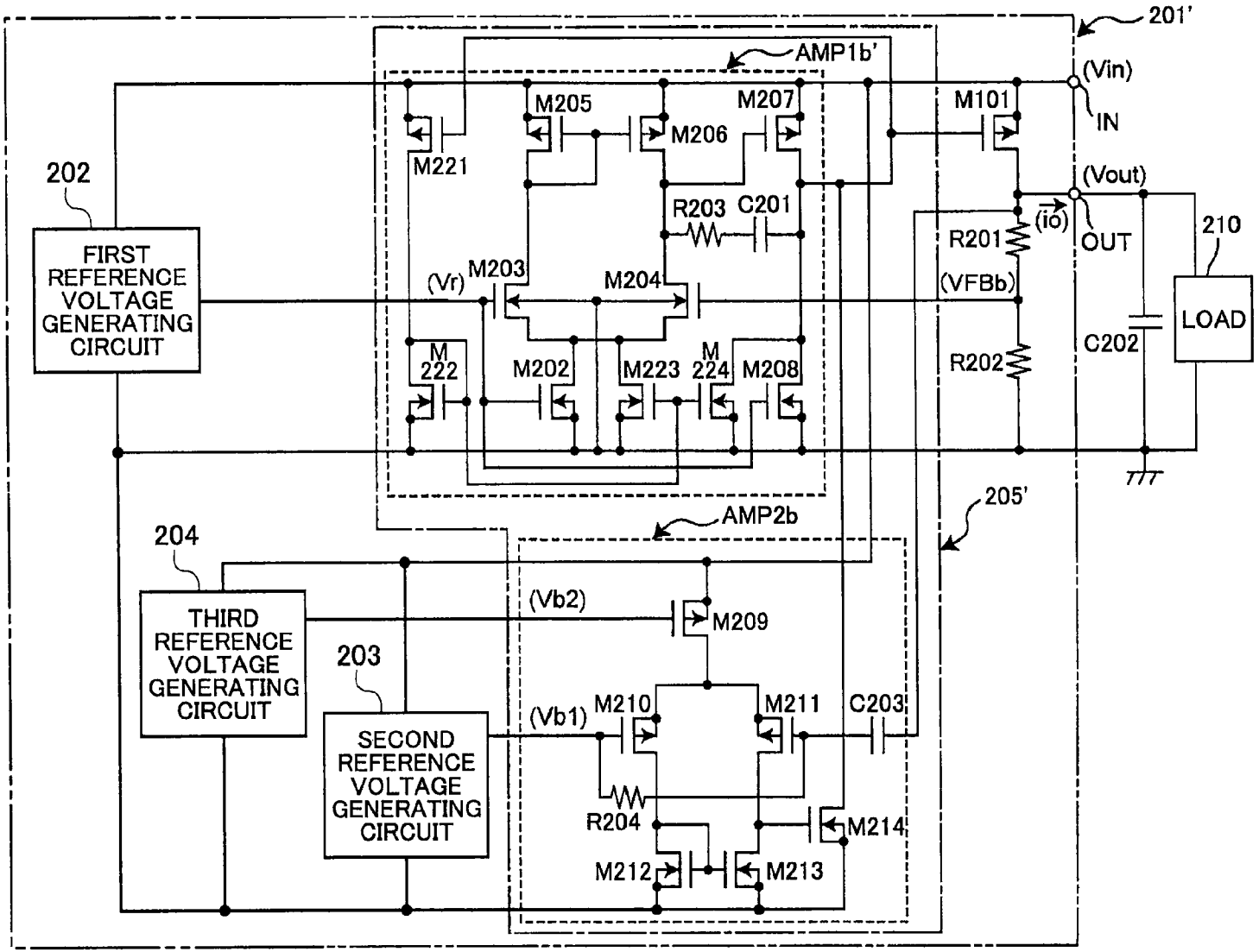
FIG. 5 is a circuit diagram showing another exemplary configuration of a constant voltage circuit according to a modified embodiment of the second embodiment.

FIG. 5 is a circuit diagram showing an exemplary configuration of a constant voltage circuit according to a modified embodiment of the second embodiment. It is noted that components of FIG. 5 that are identical to those shown in FIG. 3 are assigned the same numerical references and their descriptions are omitted.

According to the modified embodiment of FIG. 5, the error amplifying circuit unit 205' is arranged to vary the bias current of the first error amplifier AMP1*b*' according to the output current io. The constant voltage circuit 201' of FIG. 5 differs from the constant voltage circuit 201 of FIG. 4 in that it includes an additional circuit realized by a PMOS transistor M221 and NMOS transistors M222~M224 for adjusting the bias current of the first error amplifier AMP1*b*' according to the output current io.

The first error amplifier AMP1*b*' of FIG. 5 includes NMOS transistors M202~M204, M208, and M222~M224, PMOS transistors M205~207 and M221, a condenser C201, and a resistor R203. The PMOS transistor M221 and the NMOS transistor M222 are serially connected between the input terminal IN and the ground voltage, and the gate of the PMOS transistor M221 is connected to the gate of the output voltage control transistor M201. The NMOS transistors M222~M224 form a current mirror circuit, an the gates of the NMOS transistors M222~M224 are interconnected. The connection point of the gates of the NMOS transistors M222~M224 is connected to the drain of the NMOS transistor M222. The NMOS transistor M223 is connected in parallel with the NMOS transistor M202, and the NMOS transistor.

According to the present embodiment, the transistor size of the PMOS transistor M221 is designed to be 1/1000~1/10000 the size of the output voltage control transistor M201, and the PMOS transistor M221 is arranged to output a current in proportion to the output current io. The current output by the PMOS transistor M221 that is proportional to the output current io is generated by the current mirror circuit that is realized by the NMOS transistors M222~M224. The generated proportional current is supplied as a bias current to the NMOS transistors M203 and M204 realizing a differential pair via the NMOS transistor M223, and the generated proportional current is supplied as a bias current to the NMOS transistors M210 and M211 realizing a differential pair via the NMOS transistor M224.

According to the present embodiment, the NMOS transistors M203 and M204 realizing a differential pair in the first error amplifier AMP1*b*' receive a predetermined bias current from the NMOS transistor M202 and a bias current that is proportional to the output current io from the PMOS transistor M221 and the NMOS transistors M222 and M223. Also, the PMOS transistor M207 that realizes an amplifying stage circuit in the first error amplifier AMP1*b*' receives a predetermined bias current from the NMOS transistor M208 and a bias current that is proportional to the output current io from the PMOS transistor M221 and the NMOS transistors M222 and M224. In this way, the constant voltage circuit 201' according to the present embodiment may realize an increased response speed for responding to a change in the output voltage Vout according to a change in the output current io in addition to realizing the advantageous effects of the constant voltage circuit 201 of FIG. 4. It is noted that in the first error amplifier AMP1*b*' of FIG. 5 the bias current is reduced in order to reduce the power consumption during no-load time. Accordingly, when the load abruptly changes from a no-load state to a heavy-load state, the rise time of the first error amplifier AMP1*b*' may be delayed by the time required to increase the bias current. In this regard, by incorporating the second error amplifier AMP2*b*, high speed rise may be realized while maintaining a low power consumption rate.

Further, the present invention is not limited to the specific embodiments described above, and variations and modifications may be made without departing from the scope of the present invention.

The present application is based on and claims the benefit of the earlier filing date of Japanese Patent Application No. 2004-095544 filed on Mar. 29, 2004, Japanese Patent Application No. 2004-139948 filed on May 10, 2004, Japanese Patent Application No. 2005-069480 filed on Mar. 11, 2005, and Japanese Patent Application No. 2005-069491 filed on Mar. 11, 2005, the entire contents of which are hereby incorporated by reference.

What is claimed is:

1. A constant voltage circuit that converts an input voltage input to an input terminal into a predetermined constant voltage and outputs the predetermined constant voltage from an output terminal, the constant voltage circuit comprising:

an output voltage control transistor that receives an input control signal from the input terminal and outputs a current according to the input control signal to the output terminal;

a reference voltage generating circuit unit that generates and outputs a predetermined reference voltage;

an output voltage detection circuit unit that detects an output voltage from the output terminal, and generates and outputs a proportional voltage that is proportional to the detected output voltage; and a first error amplifier that conducts the operation control of the output voltage to adjust the proportional voltage to correspond to the reference voltage; and a second error amplifier with a higher response speed for responding to a change in the output voltage compared to the response speed of the first error amplifier, the second error amplifier being configured to increase the output current of the output voltage control transistor for a predetermined amount of time in response to a sudden decrease in the output voltage, wherein the second error amplifier includes:

a control transistor that conducts operation control of the output voltage control transistor according to an input control signal;

a differential amplifying circuit that includes a first input terminal and a second input terminal, and is configured to input a predetermined bias voltage via the first input terminal and conduct operation control of the control transistor to adjust a voltage of the second input terminal to correspond to the predetermined bias voltage;

a condenser that is connected between the second input terminal of the differential amplifying circuit and the output voltage; and a fixed resistor that is connected between the first input terminal and the second input terminal of the differential amplifying circuit.

2. The constant voltage circuit as claimed in claim 1, wherein a response speed of the second error amplifier for responding to a change in the output voltage is arranged to be faster than the response speed of the first error amplifier for responding to the change in the output voltage.

3. The constant voltage circuit as claimed in claim 1, wherein a direct current gain of the first error amplifier is arranged to be greater than a direct current gain of the second error amplifier.

4. The constant voltage circuit as claimed in claim 1, wherein the second error amplifier only amplifies an alternating current component of the output voltage.

5. The constant voltage circuit as claimed in claim 1, wherein:

the differential amplifying circuit includes a first transistor and a second transistor that realize a differential pair, an offset being set to at least one of the first and second transistors; and when a voltage change of the output voltage is less than or equal to a predetermined value, a current flowing in one of the first and second transistors of the differential pair is arranged to be lower than a current flowing in the other one of the first and second transistors.

* * * * *